US006772995B2

(12) United States Patent
Wen et al.

(10) Patent No.: US 6,772,995 B2
(45) Date of Patent: Aug. 10, 2004

(54) AUTOMATIC STAPLE REMOVERS

(75) Inventors: Songbai Wen, Yurisheng Electronic (Shenzhen) Limited, Shikeng Gongyecun, Xilipingshan, Nanshan District, Shenzhen, Guangdong Province (CN), 518055; Guanyu Dong, Fushun (CN)

(73) Assignee: Songbai Wen, Guangdong Province (CN)

( * ) Notice: Subject to any disclaimer, the term of this patent is extended or adjusted under 35 U.S.C. 154(b) by 0 days.

(21) Appl. No.: 10/437,712

(22) Filed: May 14, 2003

(65) Prior Publication Data

US 2004/0041135 A1 Mar. 4, 2004

(30) Foreign Application Priority Data

Sep. 3, 2002 (CN) ..... 02273047 U

(51) Int. Cl.[7] ..... B25C 11/00

(52) U.S. Cl. ..... 254/28

(58) Field of Search ..... 254/28, 18, 30

(56) References Cited

U.S. PATENT DOCUMENTS 3,126,195 A * 3/1964 Taylor ..... 254/28
4,377,190 A * 3/1983 Pierrat ..... 254/93 H

* cited by examiner

*Primary Examiner*—Robert C. Watson
(74) *Attorney, Agent, or Firm*—Norris McLaughlin & Marcus P.A.

(57) ABSTRACT

The present invention provides an automatic staple remover including a frame, a motor fixed to the frame, a speed-reducing mechanism driven by the motor, a transmission mechanism connected to the speed-reducing mechanism, and a member having a jaw for removing a staple from an object connected to the transmission mechanism. The staple remover of the invention is convenient to use and to collect removed staples.

9 Claims, 8 Drawing Sheets

AUTOMATIC STAPLE REMOVERS

TECHNICAL FILED OF THE INVENTION

The present invention relates to a device for removing staples from on object, particular to an automatic staple remover.

BACKGROUND OF THE INVENTION

In the prior art, the staple remover is operated by hand, and no automatic staple removers have been disclosed. The staple remover in the art has many drawbacks such as inconvenient to use, not easy to collect pulled staples, and readily to have the object that the staple is enclosed broken down.

Therefore, it is needed to develop a new staple remover to solve the problems existing in the art.

SUMMARY OF THE INVENTION

Accordingly, the object of the invention is to provide an automatic staple remover that has a simple structure, is easily operate, and can collect removed staples.

The automatic staple remover according to the invention includes a frame, a motor fixed to the frame, a speed-reducing mechanism driven by the motor, a transmission mechanism connected to the speed-reducing mechanism, and a member having a jaw for removing a staple from an object connected to the transmission mechanism.

In one embodiment of the invention, the staple remover further comprises a transition member adjacent to the member for removing the staple mounted to the bottom of the frame.

In another embodiment of the invention, the staple remover further comprises comprising a magazine for containing the staple.

In another preferred embodiment of the invention, the staple remover comprises a switch mounted on the frame for triggering the motor via the shaft.

DETAILED DESCRIPTION OF THE INVENTION

Figure 1:
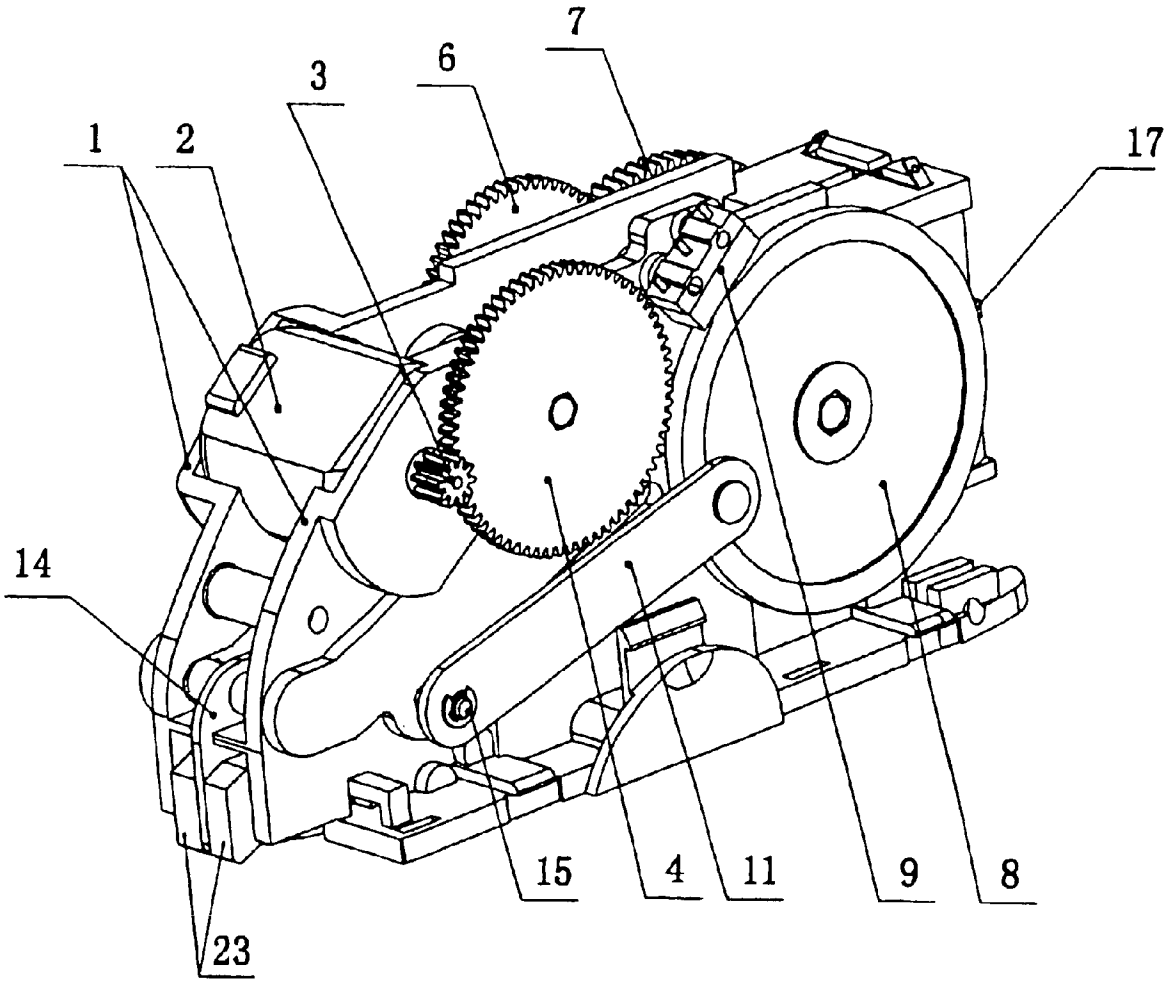
FIG. 1 is a perspective view of a staple remover of the invention.
Figure 2:
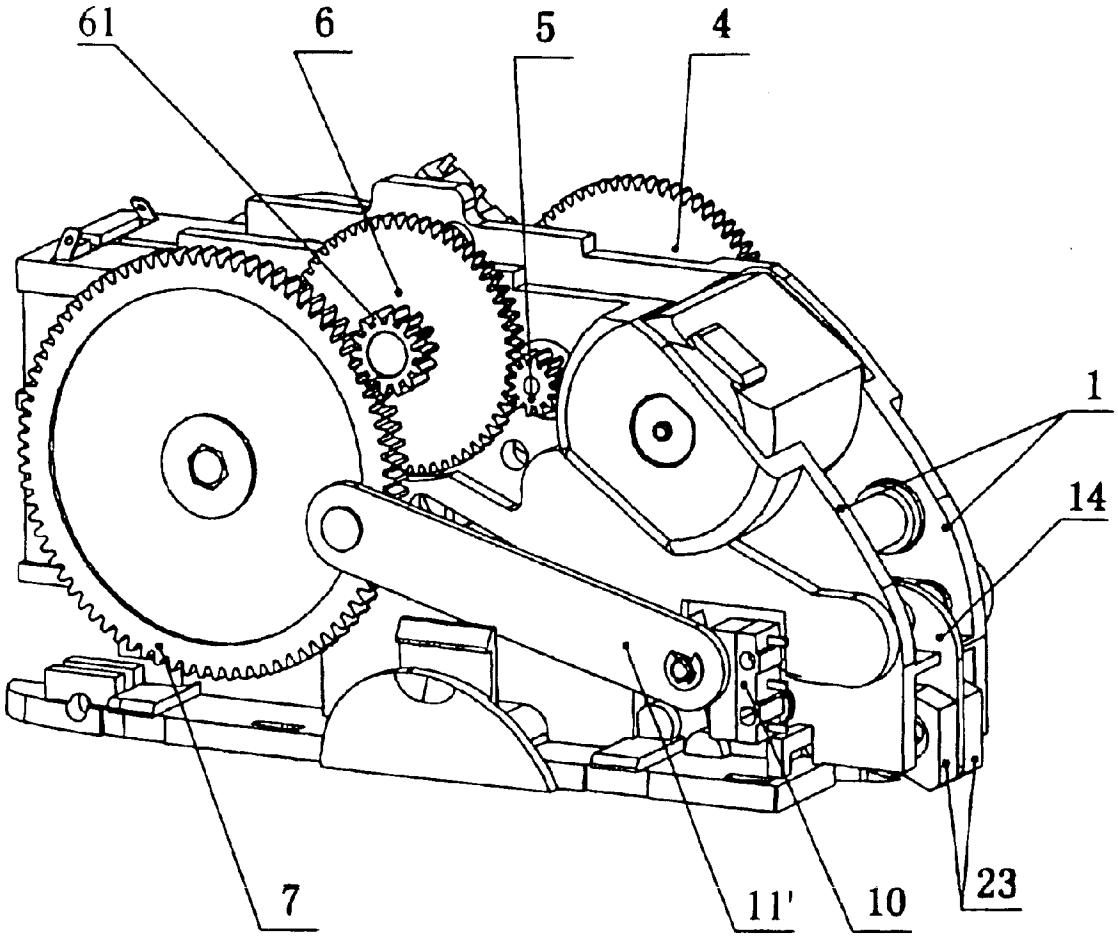
FIG. 2 is a perspective view of the staple remover shown in FIG. 1 in another direction.

The invention will be further described in conjunction with the drawings.

Referring to FIGS. 1–4, a staple remover of the present invention includes a frame 1. A motor 2 is arranged at the front portion of the frame 1. A gear assembly including a plurality of gears with different diameters is connected to the motor. A first gear 3 with a small diameter is driven by the motor 2. The first gear is engaged to a second gear 4 with a larger diameter than the first gear 3. A third gear 5 with a smaller diameter than the second gear 4 is fixed to the axle of the second gear 4 at the other side of the frame 1. The third gear 5 is engaged to a fourth gear 6 with a larger diameter than the third gear 5. At the same side of the fourth gear 6 is disposed a fifth gear 61 that shares the same axle as the fourth gear 5 and has a smaller diameter than fourth gear 5. The fifth gear 61 is engaged to a sixth gear 7 with a larger diameter than the fifth gear 61.

A driving wheel 8 that has the same diameter as the sixth gear 7 is fixed to the axle of the sixth gear 7. Two connecting rods 11, 11' are connected between the edge of the driving wheel 8, the sixth gear 7 and a shaft 15. A member 14 including a jaw 141 for removing a staple is mounted to the shaft 15. At two sides of the frame 1 are provided two slide channels 16. The shaft 15 is mounted in the channels 16 via two sleeves 21 such that the member 14 can move along the channels 16.

Figure 4:
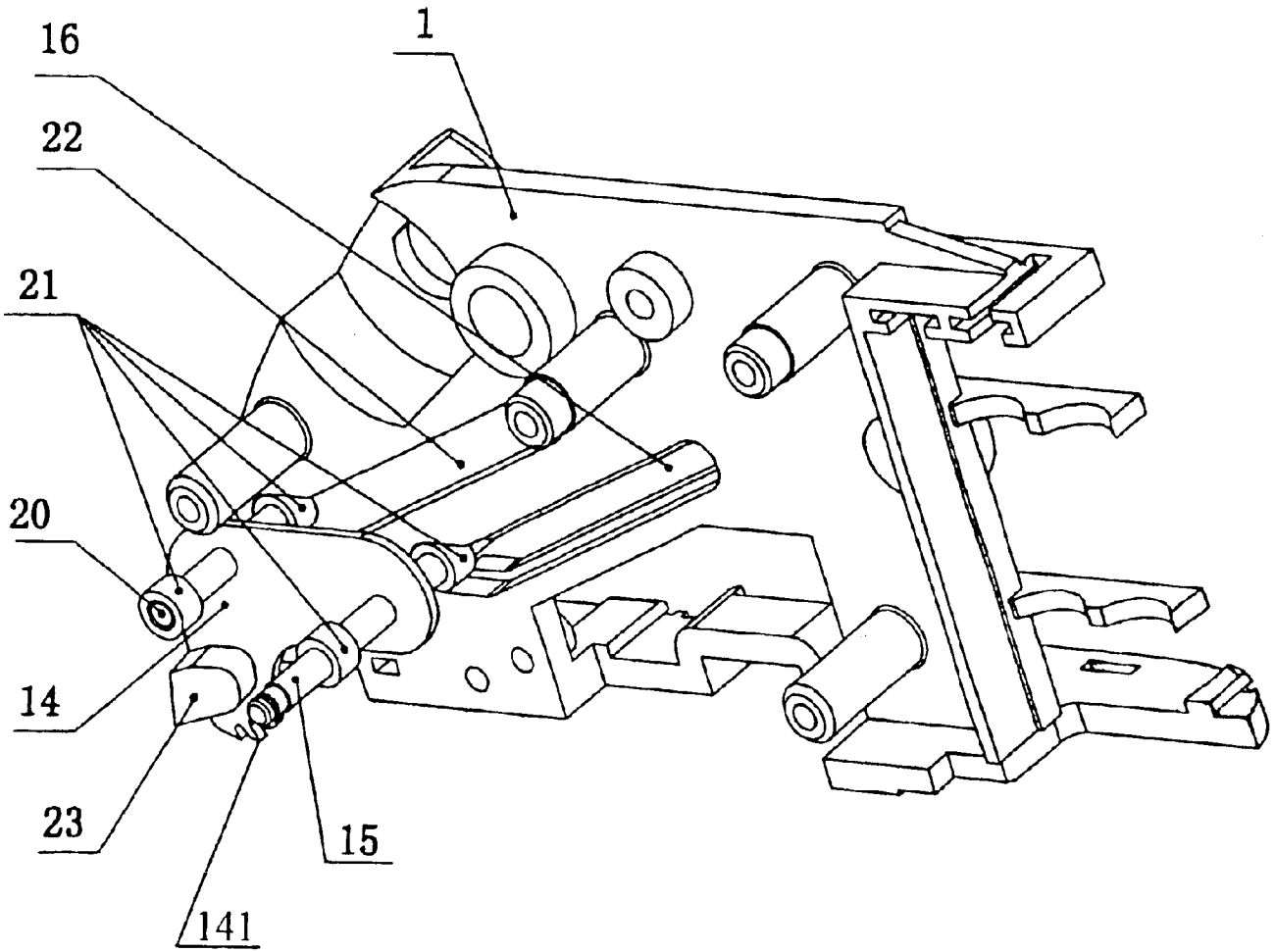
FIG. 4 is a partially schematic view of the staple remover shown in FIG. 1 from the bottom.

Referring to FIG. 4 now, there is provided another shaft 20 at the front portion of the frame parallel to the shaft 15. The shaft 20 is disposed within two inclined channels 22 parallel to the channels 16.

Figure 3:
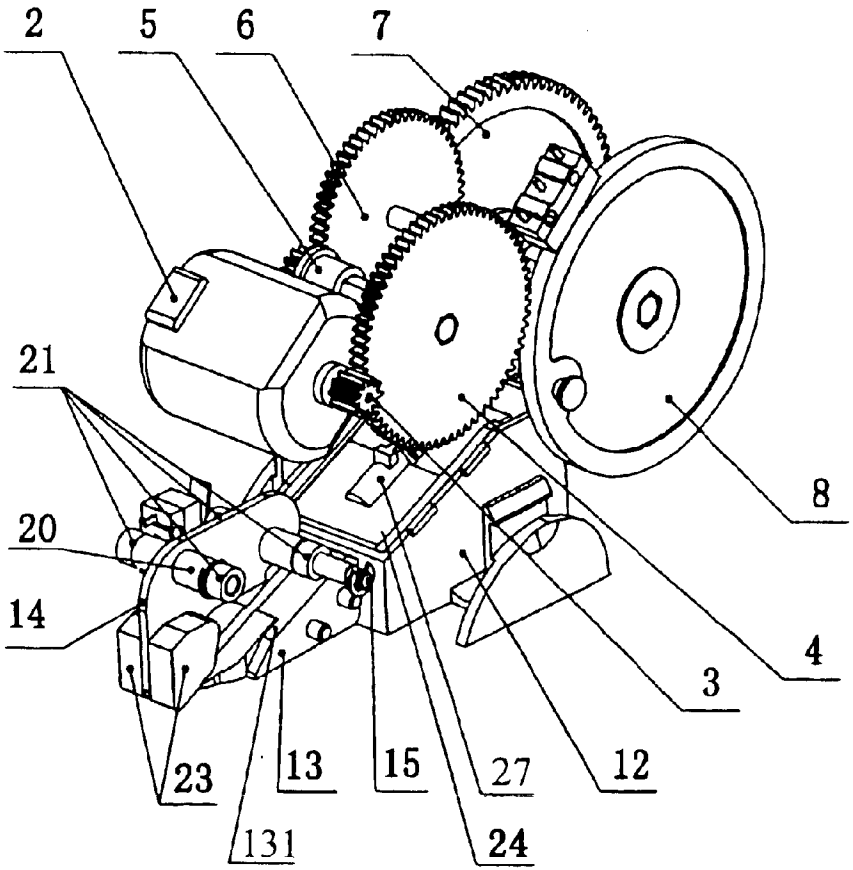
FIG. 3 is a partial perspective view of the staple remover shown in FIG. 1.
Figure 6B:
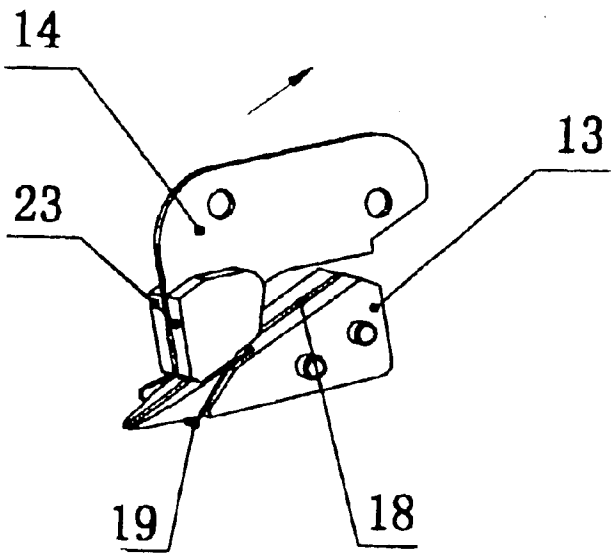
FIG. 6*b* shows the movement of the member for removing staples on the transition member according to the invention.
Figure 6A:
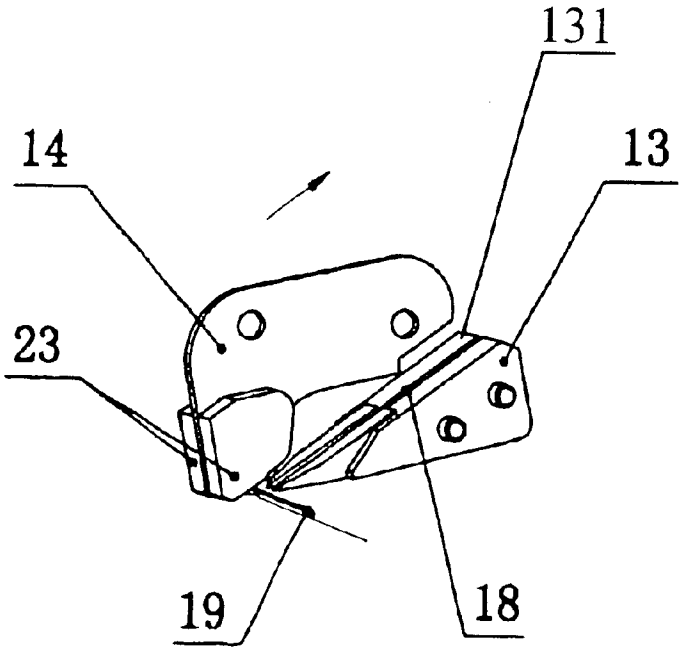
FIG. 6*a* shows pulling a staple using the staple remover of the invention.

Turning to FIGS. 3, 6*a*, and 6*b*, a transition member 13 is disposed at the bottom of the frame adjacent to the member for removing the staple, and has an inclined plane 131 providing a groove 18 that allows the jaw 141 of the member 14 to move along the inclined plane 131.

Figure 7B:
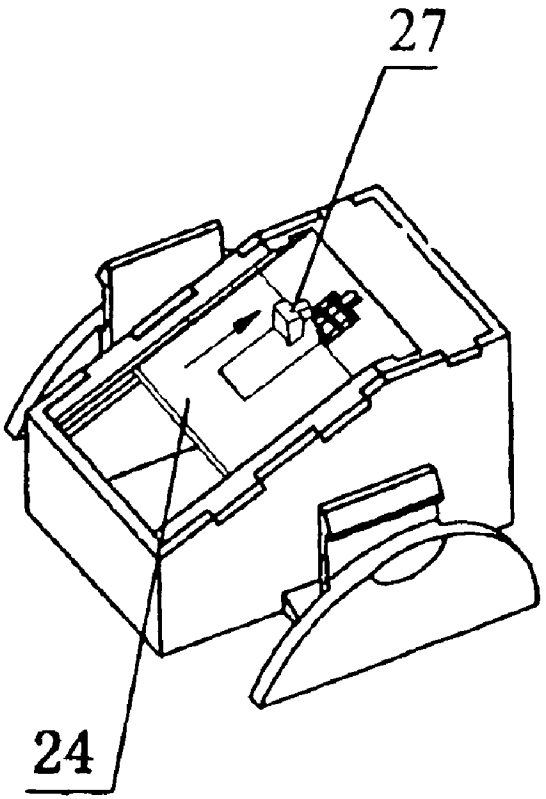
FIG. 7*b* schematically shows the magazine at an open state.
Figure 7A:
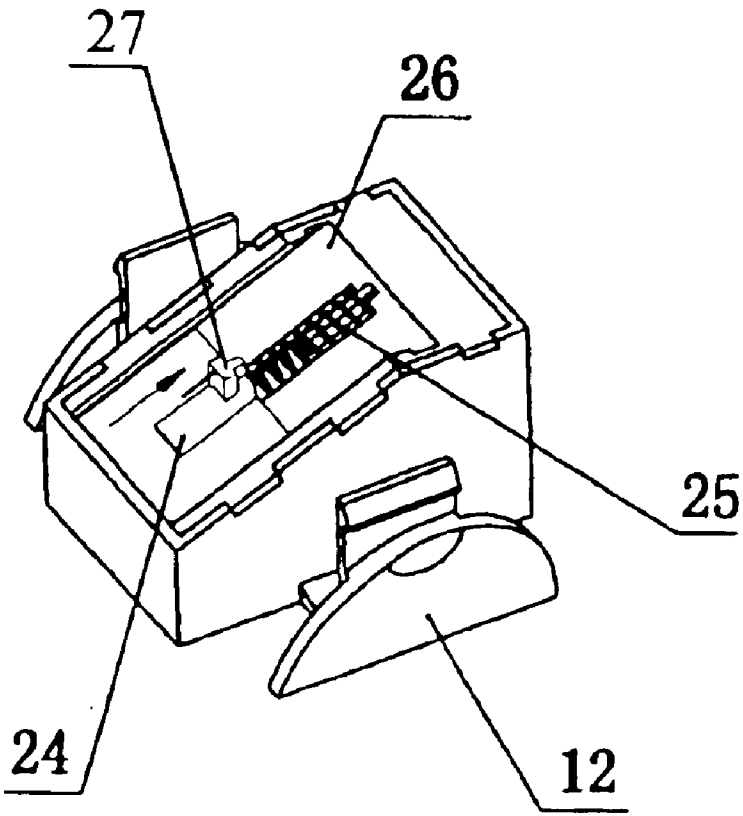
FIG. 7*a* schematically shows the magazine at a close state.

Referring to FIG. 3, FIG. 7*a* and FIG. 7*b*, adjacent to the transition member 13 on the frame is disposed a magazine 12 for containing the removed staple 19. The magazine 12 at the upper portion provides a bevel plane 26 extended from the inclined plane 131 of the transition member 13. Onto the bevel plane 26 is provided a slide plate 24 to which a driving block 27 is mounted. A spring 25 is arranged at the plane 26 and is connected to the slide plate 24.

As shown in FIGS. 1, 3, 6*a*, and 6*b*, the member 14 may include a pair of blocks 23 at the two sides of the jaw to prevent the staple 19 from sliding off while operating.

Figure 5:
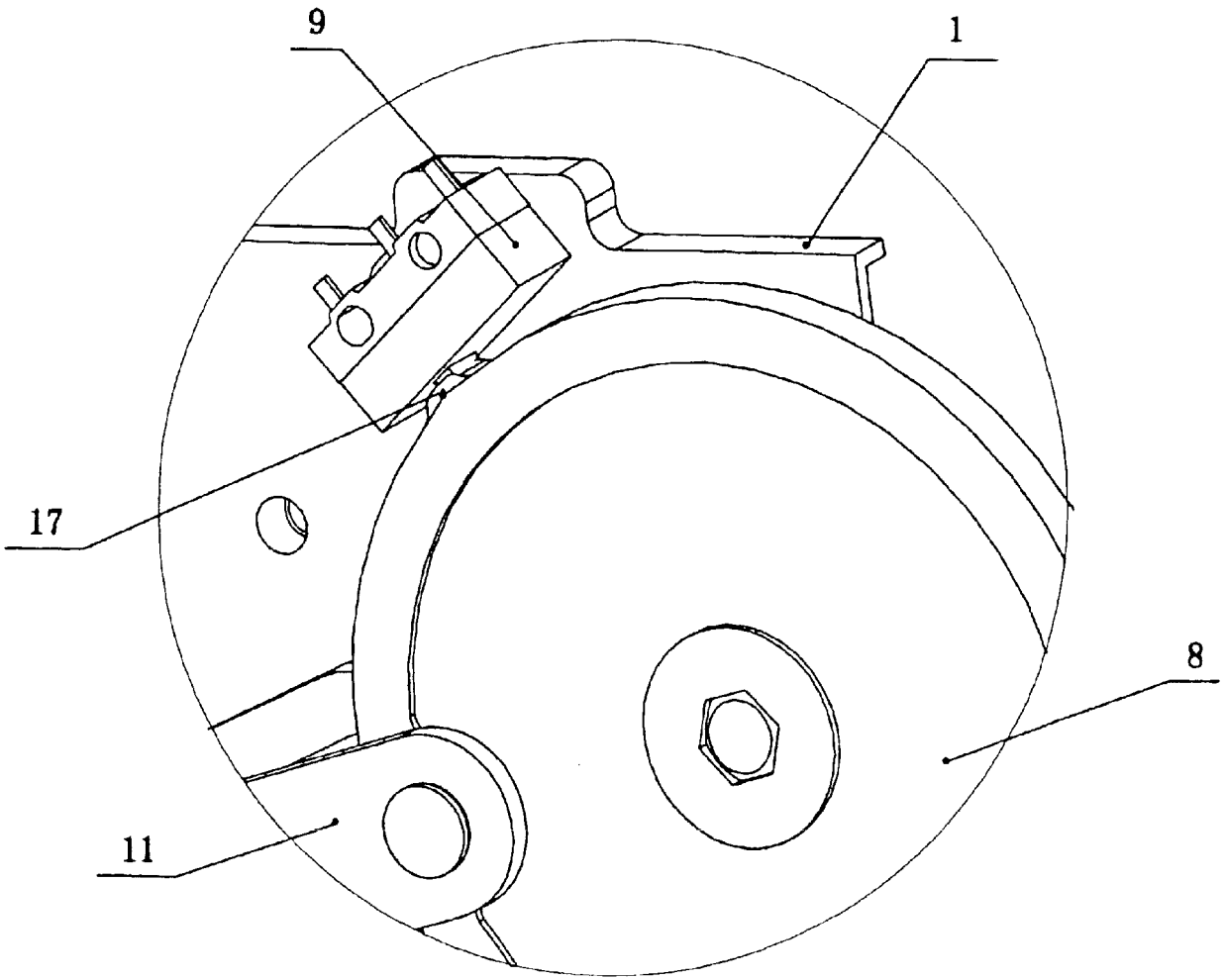
FIG. 5 is a partial view of the staple remover of the invention showing that the switch contacts a project on the driving wheel.

Now turning to FIG. 5, a position-limit switch 9 is provided at the upper portion of the frame 1. The position-limit switch 9 can contact a projection 17 disposed at the outer edge of the driving wheel 8.

The operation of the staple remover according to the invention is now described.

Figure 8:
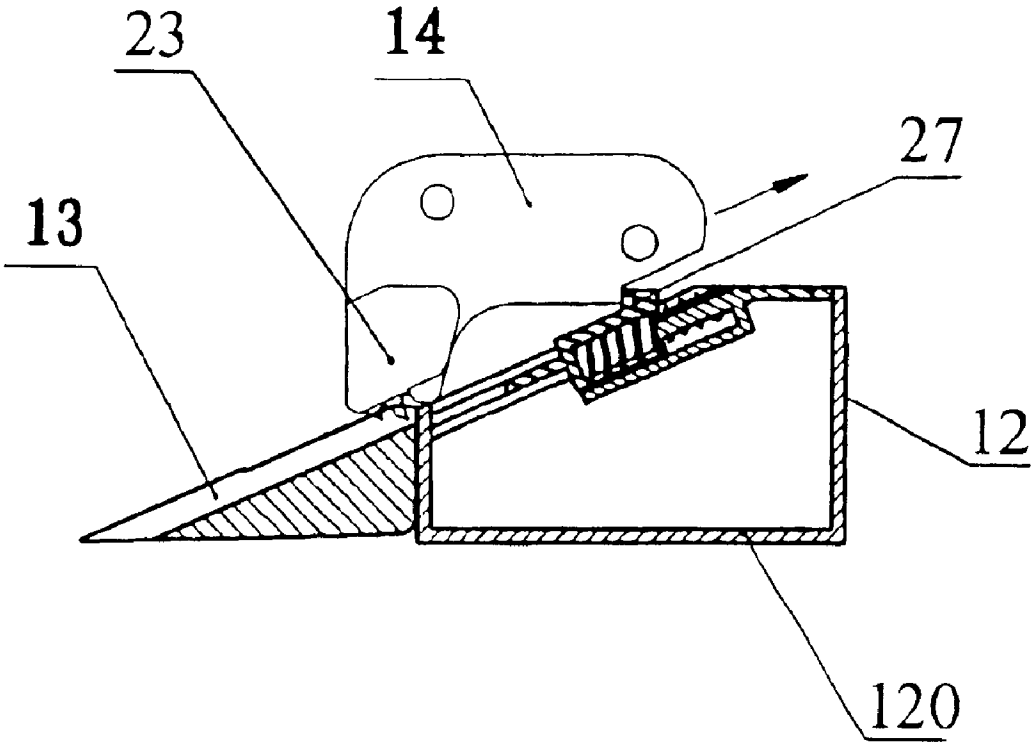
FIG. 8 is a cross-sectional view of a transition member and a magazine of the invention.

When the jaw 141 of the member 14 is put under the staple 19 as shown in FIG. 6*a*, a switch 10 disposed on the frame 1 is initiated to drive the motor 2 via the shaft 15. The motor 2 drives the sixth gear 7 and the driving wheel 8 to rotate though the gear assembly. With the rotation of the gear 7 and the driving wheel 8, the connecting rods 11, 11' are driven to direct the member 14 to move along the inclined channels 16, 22. At the same time, the removed staple with the jaw 141 moves along the groove 18 at the upper surface of the transition member 13 to reach the magazine 12. The rear part of the member 14 pushes the driving block 27 on the slide plate 24 to move backwards so as to open the magazine. When the jaw moves above the magazine, the staple falls into the magazine by the weight. As shown in FIG. 8, the bottom 120 of the magazine 12 may be made from magnetic materials. At this time, the projection 17 contacts the switch 9 to stop the motor 2 to finish a cycle of removing the staple.

We claim:

1. An automatic staple remover comprising:

a frame;

a motor fixed to said frame;

a speed-reducing mechanism which can be driven by said motor;

a transmission mechanism connected to said speed-reducing mechanism;

a member having a jaw for removing a staple from an object connected to said transmission mechanism; and a transition member adjacent to the member mounted to the bottom of the frame, wherein said transition member comprises an inclined plane having a groove along which the member is movable.

2. The staple remover according to claim 1 further comprising a magazine for containing the staple.

3. The staple remover according to claim 2, wherein the magazine comprises a bevel plane at the upper portion matching the inclined plane of the transition member, a sliding plate and a spring connected to the sliding plate.

4. The staple remover according to claim 1, wherein said member comprises a pair of blocks disposed at two sides of the jaw.

5. The staple remover according to claim 1, wherein said speed-reducing mechanism comprises a gear assembly including a gear and a driving wheel mounted to the axle of the gear, wherein said transmission mechanism comprises a shaft fixed to the member, and two connecting rods connected between the shaft and the gear, the driving wheel, respectively, such that the member can be driven by the transmission mechanism to move along an inclined channels set on the frame.

6. The staple remover according to claim 1 further comprising a switch mounted on the frame for triggering the motor via the shaft.

7. The staple remover according to claim 1 further comprising a position-limiting switch disposed on the frame triggered by a projection set on the outer edge of the driving wheel to stop the motor.

8. The staple remover according to claim 6 further comprising a position-limiting switch disposed on the frame triggered by a projection set on the outer edge of the driving wheel to stop the motor.

9. The staple remover according to claim 2, wherein the magazine has a magnetic bottom.

* * * * *